United States Patent [19]

Schold

[11] Patent Number: 4,458,462

[45] Date of Patent: Jul. 10, 1984

[54] MOVABLE WALL ASSEMBLY

[76] Inventor: Carl Schold, 12545 W. Alameda Dr., Lakewood, Colo. 80228

[21] Appl. No.: 381,920

[22] Filed: May 25, 1982

[51] Int. Cl.[3] ..... E04H 1/00

[52] U.S. Cl. ..... 52/241; 52/281; 52/511; 52/508

[58] Field of Search ..... 52/281, 238, 270, 271, 52/426, 570, 571, 572, 805, 241, 511, 508, 481

[56] References Cited

U.S. PATENT DOCUMENTS

| | | | |
|---|---|---|---|
| 2,066,205 | 12/1936 | Keating | 72/118 |
| 3,176,807 | 4/1965 | Pavlecka | 52/481 |
| 3,457,698 | 7/1969 | Albers | 52/270 |
| 3,553,915 | 1/1971 | Passovoy | 52/241 |
| 3,683,575 | 8/1972 | Meziere | 52/241 |
| 3,683,576 | 8/1972 | Sikes | 52/481 |
| 3,722,163 | 3/1973 | Satkin | 52/511 |
| 3,729,889 | 5/1973 | Baruzzini | 52/481 |
| 3,731,447 | 5/1973 | Dawdy et al. | 52/489 |
| 3,753,325 | 8/1973 | Stanley et al. | 52/481 |
| 3,805,471 | 4/1974 | De Schutter | 52/714 |
| 3,986,313 | 10/1976 | Nelsson | 52/241 |
| 3,996,712 | 12/1976 | Howell | 52/241 |
| 4,000,596 | 1/1977 | Magill et al. | 52/481 |

FOREIGN PATENT DOCUMENTS

| | | | |
|---|---|---|---|
| 970923 | 7/1975 | Canada | 52/241 |

*Primary Examiner*—Henry E. Raduazo

[57] ABSTRACT

A movable wall assembly is provided which includes a back panel member and a front panel member releasably attachable to the back panel member. Each panel member includes a wallboard sheet, a L-shaped element, and a layer of wall covering. The L-shaped element of the back panel member includes a female member while the L-shaped element of the front panel member includes a male member. At spaced intervals along the female member, pin members are provided. The male member has locking slots for receiving the pin members to join the back panel member and front panel member together. The back and front panel members are formed away from the actual wall construction site so that a complete wall can be erected at the construction site using a plurality of wall assemblies while minimizing additional construction work at the site.

14 Claims, 10 Drawing Figures

MOVABLE WALL ASSEMBLY

1. FIELD OF THE INVENTION

This invention relates to a movable partition wall assembly, and, more particularly, to such an assembly formed from two panels which are adapted to be prefabricated and which are readily and quickly assembled together at the construction site.

2. Background Art

Partition wall assemblies formed from prefabricated panels have been previously devised. Such prior assemblies have included panels which at the construction site are joined together through the mating of clips and other spaced groove elements on one panel with cooperating tongue elements located on the other panel, as exemplified by the assemblies described in U.S. Pat. Nos. 2,066,205; 3,553,915; 3,753,325; 3,731,447; 3,805,471; 3,986,313; 3,996,712 and 4,000,596.

Such prior assemblies, however, have not in practice proven to be completely satisfactory due to on site vertical and horizontal alignment problems caused by even slight errors in locating the elements in the prefabrication process, a failure of the panels to be adapted for suitable use when the common deviations which occur are encountered in the actual layout of the erection enclosure, a lack of design features which would eliminate or suitably minimize the need to engage in extensive and time-consuming erection of a supporting stud frame at the site, and/or requiring expensive kerfing of all panel end edges, and the like. Moreover, by reason of the unpredictability of the reliability of such previous panels, they have discouraged attempts to achieve further economy with the prefabrication approach, such as could have been attained by installing the ultimately desired electrical service elements on the panel's back in the prefabrication process. Similarly, and further because of a lack of adaptable structure, panels heretofore proposed have not encouraged or allowed the prefabrication to the panel surfaces of the surfacing, e.g., vinyl covering, desired in the ultimate partition assembly.

Accordingly, a search has continued in the art for an improved movable partition wall assembly. In this regard, it is the primary object of the primary object of the present invention to provide an improved movable partition wall assembly.

It is another object of the present invention to provide a novel movable partition wall assembly which is essentially free of the drawbacks that characterized panel wall assemblies heretofore available.

An additional object of the present invention is to provide a novel movable partition wall assembly which advantageously may be prefabricated and then easily and quickly assembled at the erection site.

Another object of the present invention is to provide a novel movable partition wall assembly which advantageously requires little frame construction preliminary to its erection at the installation site.

A further object of the present invention is to provide a novel movable partition wall assembly which not only improves the economy of wall construction at the installation site, but promotes additional economy in the prefabrication operation, by allowing therein the installation of ultimately desired electrical service elements and/or the application to the panel surfaces of the surfacing desired in the final partition.

Still another object of the present invention is to provide a novel movable partition wall assembly in which the panels thereof are reliable and versatile in actual use.

DISCLOSURE OF THE INVENTION

In accordance with the present invention, a wall assembly is provided which includes a back panel member and a front panel member spaced from but interconnected to the back panel member. Each panel member includes a wallboard sheet. A pair of first L-shaped elements are attached to the inner face of the back wallboard sheet. A pair of second L-shaped elements are attached to the inner face of the front wallboard sheet. Each first L-shaped element has a foot portion and a stem. At the free edge of each stem, a longitudinally extending S-shaped loop is formed to define a female member. A number of pin members are inserted and held along the longitudinal extent of the female member. Each second L-shaped member also includes a foot portion and a stem. At the free edge of each stem, a male member is defined. A number of locking slots are configured in the male member. In constructing a wall partition, the back panel member is joined to a ceiling and a floorboard. The front panel member can then be joined to the back panel member using the pin members attached to the female members and the locking slots of the male members.

From the foregoing description, it is readily seen that a number of salient features of the present invention are provided. The wall assembly of the present invention can be constructed from mating wall panels. Each wall panel can be constructed away from the construction site. There is no necessity for stud connection to wallboard sheets at the time the wall is erected since the studs and wallboard sheets are provided already interconnected. Consequently, when it is desirable to erect a wall at the site, the back panel member of a desired height can be positioned and easily joined to the floorboard and ceiling. The front panel member of the same height can then be interconnected with the back panel member. Prior to joining the two panels, insulation, plumbing, and/or electrical wiring, for example, can be positioned between the two panels. Additional advantages of the present invention will become readily apparent from the following discussion when taken in conjunction with the accompanying drawings.

DETAILED DESCRIPTION OF THE PREFERRED EMBODIMENTS

Figure 1:
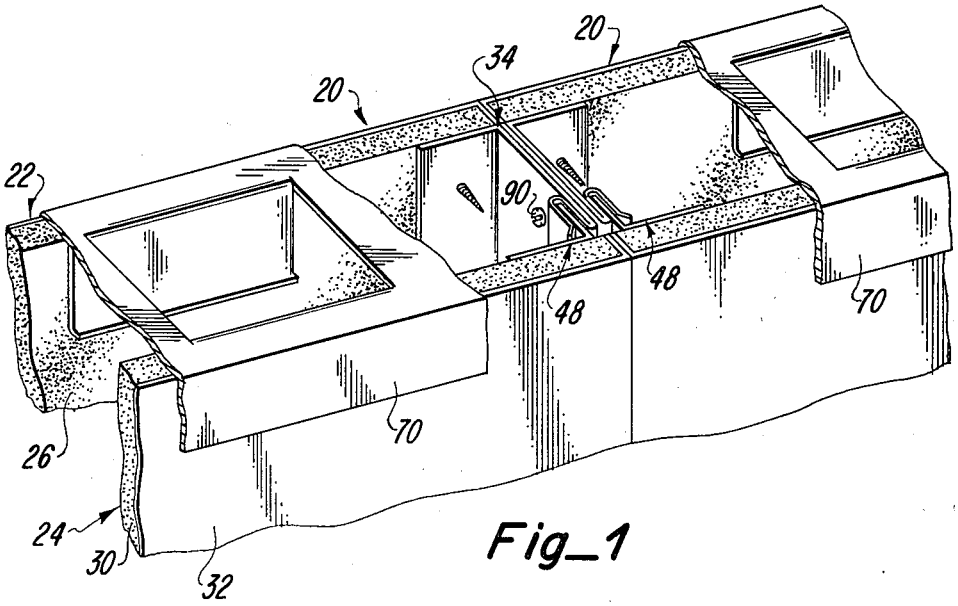
FIG. 1 is a fragmentary, perspective view showing two interconnected wall assemblies of the present invention with a portion of the top cap member cut away to illustrate the mating of back and front panels.
Figure 2:
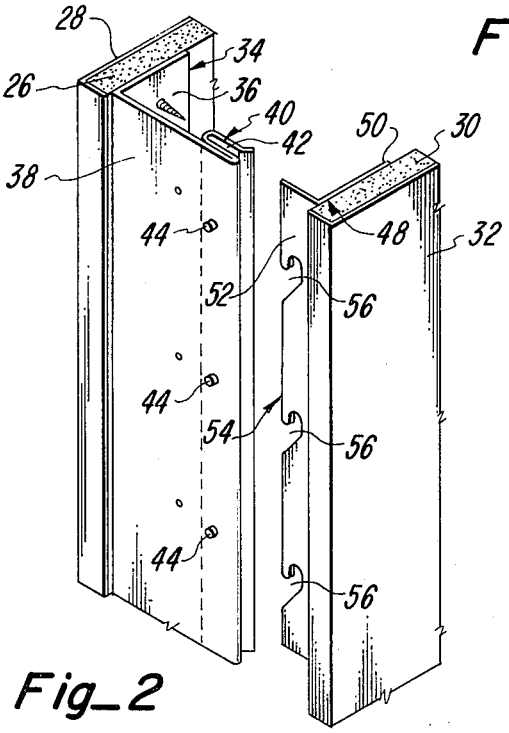
FIG. 2 is a fragmentary, explosed view showing in greater detail the female and male members.
Figure 3:
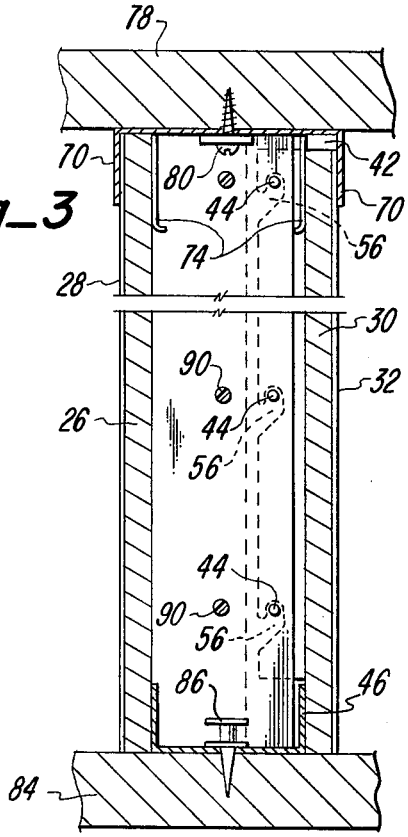
FIG. 3 is a fragmentary, longitudinal section showing the connection of the wall assembly to a ceiling and floorboard.
Figure 4:
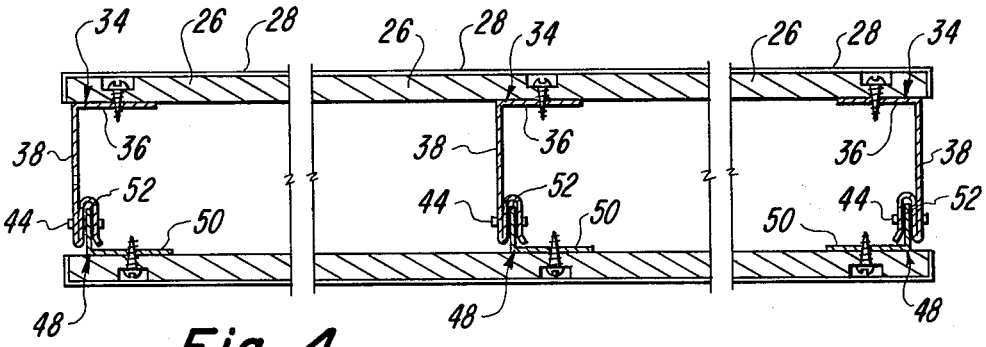
FIG. 4 is a fragmentary, lateral section showing a complete wall using the wall assemblies of the present invention.

In accordance with the present invention, as seen in FIG. 1, a wall assembly 20 is provided which can be joined together with additional wall assemblies 20 to construct a complete wall. With reference also to FIGS. 2, 3 and 4, the wall assembly 20 includes a back panel member 22 and a front panel member 24. The back panel member 22 includes a back wallboard sheet 26 and a covering layer 28 attached to the outer face of the back wallboard sheet 26. The front panel member 24 includes a front wallboard sheet 30 and a cover layer 32 attached to the outer face of the front wallboard sheet 30.

It is understood that the term "wallboard" as used herein refers to paneling formed of any material of basic primary composition, including sheets formed of one basic material such as a metal, e.g., aluminum; a mineral, e.g., gypsum and other conventional drywall forms; wood; wood particles, e.g., particle and fiber board; plastics, e.g., phenolformaldehyde resins, polyvinyl chloride, polyethylene, and the like, and paneling formed of laminates of the same. The term "covering layer" as used herein refers to a coat of a material different than that of the wallboard, such as a paint, or a thin sheet of conventional wall covering, such as a plain paper, a resin-impregnated paper, a plain or paper-supported plastic film, vinyl wall covering, and the like, with any sheet of material being suitable so long as the same is self-supporting.

Each back panel member 22 further includes a pair of first L-shaped elements or studs 34. Each L-shaped element 34 includes a longitudinally extending foot portion 36 which is attached to the inner face of the back wallboard sheet 26. The L-shaped element 34 also includes a longitudinally extending stem 38 which is integral with the foot portion 36 and which extends laterally at a right angle therefrom and from the back wallboard sheet 26. As best seen in FIGS. 1 and 2, the free end of the stem 38 is bent in a generally S-shape to define a female member 40 having a vertical slot 42. A plurality of spaced pin members 44 are inserted through and fixedly held in the vertical slots 42. Each of the pin members 44 is positioned horizontally into the lateral depth of the vertical slots 42.

As shown in FIG. 3, a generally U-shaped, in longitudinal cross-section, bottom plate member 46 is fixedly fastened to the bottom edge of the back panel member 22 at the inner face of the back wallboard sheet 26. The attachment of the bottom plate member 46 to the back wallboard sheet 26, as well as the attachment of the foot portion 36 to the back wallboard sheet 26, is accomplished in a conventional manner.

Each front panel member 24 further includes a pair of second L-shaped elements 48. Each second L-shaped element 48 includes a foot portion 50 attached to the inner face of the front wallboard sheet 30 and a stem 52 integral with the foot portion 50 and extending at a right angle therefrom and from the front wallboard sheet 30. The free end of the stem 52 defines a male member 54 having a plurality of locking slots 56 formed therein. As illustrated in FIG. 2, each locking slot 56 is defined by a path inwardly from the free edge of the stem 52.

Figure 6:
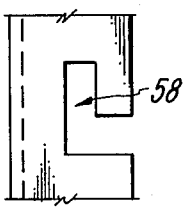
FIG. 6 is an enlarged, fragmentary, longitudinal section showing another embodiment of the locking slot of the present invention.
Figure 7:
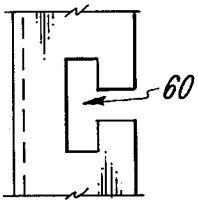
FIG. 7 is an enlarged, fragmentary longitudinal section of still another embodiment of the locking slot of the present invention.
Figure 8:
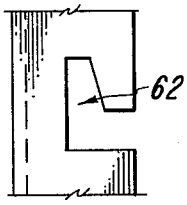
FIG. 8 is an enlarged, fragmentary, longitudinal section showing still yet another embodiment of the locking slot of the present invention.

As seen in FIGS. 6, 7 and 8, the locking slot 56 can assume a variety of configurations. The locking slot 56 of FIG. 2 continues upwardly along a curved or rounded path along the free edge of the male member 54. The path of locking slot 58 of FIG. 6 is characterized by an upward portion formed at a right angle to a lateral open portion. The path of locking slot 60 of FIG. 7 is characterized by the inclusion of both upwardly and downwardly extending open portions. The path of locking slot 62 of FIG. 8 is characterized by an upwardly extending slot portion having an inclined edge. From these different embodiments, it is readily understood that a locking slot can be devised in many forms to receive the pin members 44. In addition, it can be appreciated that the front panel member 24 can be interconnected with the back panel member 22 by permitting the pin members 44 to be received and held in an upwardly extending portion of a locking slot or by permitting the pin members 44 to be received and held in a downwardly extending portion of a locking slot. Like the back panel member 22, the manner of attachment of the foot portions 50 of the second L-shaped elements 48 to the inner face of the front panel member 24 is by conventional means such as screws. Preferably, the fasteners for holding the L-shaped elements 34, 48 to the back wallboard sheet 28 and front wallboard sheet 30 are provided before the covering layers 28, 32 are joined to the outer faces thereof. As a consequence, these fasteners are hidden from view.

Figure 5:
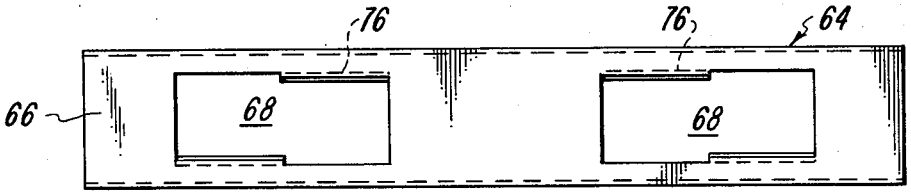
FIG. 5 is a top plan view of the top cap member of the present invention.

In constructing a complete wall using wall assemblies 20, top cap members 64 are used in connecting a wall assembly to a ceiling. As seen in FIG. 5, the top cap member 64 includes a plate 66 having a pair of generally rectangular openings 68. Each top cap member 64 also has side plates 70, as best seen in FIG. 1, extending throughout the longitudinal extent of the top cap member 64. Intermediate plates 74 are also formed inwardly of the side plates 70 to define U-shaped elongated channels 76 between the intermediate plate 74 and the side plates 70. Each of these intermediate plates 74 is formed at an edge of the rectangular openings 68 and extends for about one-half the longitudinal extent of the openings 68.

Figure 9:
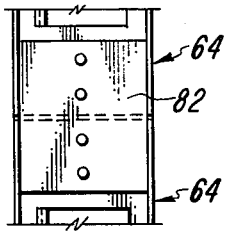
FIG. 9 is a fragmentary, lateral section showing the plate for joining adjacent top cap members together.
Figure 10:
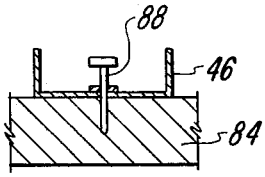
FIG. 10 is a fragmentary, longitudinal section showing another embodiment for joining the back panel member to a floorboard.

The top cap member 64 is fastened to a ceiling 78, as illustrated in FIG. 3, by a standard connector 80. As seen in FIG. 9, top cap members 64 can be interconnected using a common joining device such as a plate 82 which bridges the ends of the two adjacent top cap members 64 and is attached to each of them. Accordingly, in forming a complete wall, top cap members 64 are joined together and to the ceiling 78 in the room or area in which a wall or partition is to be erected. After the top cap members 64 are in place, the top edge of each back panel member 22 is inserted into and received by one of the channels 76. It is understood that each back panel member 22 is formed having a height substantially equal to the distance between the ceiling 78 and a floorboard 84. The back panel member 22 is attached to the floorboard 84 by conventional means, such as screws 86, as illustrated in FIG. 3. Other conventional fastening devices can be utilized such as the connecting pin 88 shown in FIG. 10 which can be inserted into the bottom plate member 46 and floorboard 84 using a conventional handheld trigger-operated deviced.

After a back panel member 22 is in place, additional back panel members 22 can be joined together. As illustrated in FIG. 1, the side, vertically extending edges of two adjacent back panel members 22 are aligned and fasteners 90 are inserted along the longitudinal extend thereof interconnecting stems 38 of two adjacent first L-shaped elements 34. As can be seen in FIG. 2, the stem 38 of the first L-shaped element 34 and the stem 52 of the second L-shaped element 48 are recessed slightly relative to the edges of the wallboard sheets 26, 30, respectively. As a consequence, the L-shaped elements 34, 48 are not exposed at the junction of two wall assemblies 20 and a close abutment is provided between the two wall assemblies 20.

After the necessary number of back panel members 22 have been joined together and to the ceiling 78 to form one side of a complete wall, desired materials or components can be placed within the back panel members 22 and/or attached thereto. For example, electric wiring can be located and attached to the inner face of the back panel member 22 and run upwardly or downwardly relative to the ceiling 78 or floorboard 84. Similarly, plumbing can be provided adjacent the inner face of a back panel member 22. By way of further example, insulation can be placed adjacent the inner face of a back panel member 22. It is also appreciated that such materials can be attached to back panel members 22 prior to erection at the construction site.

Subsequent to the placement and fixing of electrical wiring, plumbing, insulation, or any other material within the back panel members 22, a front panel member 24 is joined to each of the back panel members 22. In this regard, the locking slots 56 are aligned to receive the pin members 44. In the embodiment of FIGS. 2 and 3, the pin members 44 enter the locking slot 56 and the front panel member 24 is dropped slightly or falls so that the pin members 44 are received and held in the upwardly extending curved slot portion of the locking slot 56. As can be seen in FIG. 3, the front panel member 24 does not abut the under side of the top cap member 64 so that these front panel members 24 can be readily removed by lifting upwardly thereon and then pulling outwardly. When the front panel member 24 is in place the side plates 70 act to hide the gaps 92 from view, as seen in FIG. 3.

From the foregoing description of the invention embodiments, a number of worthwhile advantages of the present invention are readily discerned. A wall assembly is provided which can be made away from the actual wall construction site. The studs and wallboard sheets are not connected by workmen at the site, rather, they are assembled before shipment to the site so that the time involved in actually erecting the wall is minimized. The wall assembly is fabricated using two mating elements so that fixtures or materials can be placed between the panels of the wall assembly before or at the time of the erection of the wall. The wall assembly can be made to any desired height and wall assemblies can be joined together to form a partition for any size area or room. the wall assemblies are closely abutted together to provide a smooth, virtually continuous appearance.

Although the present invention has been described with reference to a plurality of embodiments, it is readily appreciated that still yet other variations and modifications can be effected within the spirit and scope of this invention.

What is claimed is:

1. A wall assembly comprising:

a back panel member comprising a first wallboard sheet having an inner face and an outer face, at leasts a pair of spaced, first L-shaped elements attached to said inner face of said first wallboard sheet, each of said first L-shaped elements having a foot portion and a stem and said stem having a free edge, each of said first L-shaped elements being positioned vertically with said foot portion thereof flush against said first wallboard sheet and said stem thereof extending from said first wallboard sheet, said free edge of said stem of each of said first L-shaped elements formed to provide a vertical slot that extends substantially the length of the corresponding first L-shaped element, thereby defining a female member; and a plurality of vertically spaced, substantially horizontal pin members wherein each of said pin members intersects the free edge of one of said first L-shaped elements at least twice and thereby transverse the slot which defines the corresponding female member; and a front panel member comprising a second wallboard sheet having an inner face and an outer face, at least a pair of spaced second L-shaped elements attached to said inner face of said second wallboard sheet, each of said second L-shaped elements having a foot portion and a stem and said stem having a free edge;

each of said second L-shaped elements being positioned vertically with said foot portion thereof flush against said second wallboard sheet and said stem thereof extending from said second wallboard sheet, said free edge of said stem of each of said second L-shaped elements defining a male member, and a plurality of spaced, locking slots positioned on each of said male members, the locking slots extending inwardly from said free edges of said stem, the relative sizes and locations of said female members and said male members and said respective pin members and locking slots thereon being such that said male members each are received within said female members and said pin members are received within said locking slots, whereby a composite hollow, panel wall assembly is provided within said mated first and second L-shaped elements cooperatively form spaced U-shaped webs between and supporting said first and second wallboard sheets with the respective outer faces of said sheets facing outwardly.

2. The wall assembly, as claimed in claim 1, wherein:

said slot of each of said first L-shaped elements has a lateral opening, and the lateral cross-sectional width of each said slot is the greatest at the lateral opening thereof, and decreases inwardly therefrom.

3. The wall assembly, as claimed in claim 1, further including:

a top cap member having spaced longitudinally extending slots in which top edges of said first and second wallboard sheets are received;

a U-shaped bottom plate member attached to said inner face of said back wallboard sheet adjacent the bottom edge thereof; and fastening means for anchoring said bottom plate member to a floor surface.

4. The wall assembly, as claimed in claim 1, wherein: said outer face of at least one of said first or second wallboard sheets is provided with a layer of wall covering, different from the basic composition of said first or second wallboard sheets.

5. The wall assembly, as claimed in claim 4, wherein: said wall covering is a thin sheet of vinyl wall covering.

6. The wall assembly, as claimed in claim 1, wherein: the space between said first and second wallboard sheets are located electrical service elements so positioned by attachment to the inner face of said back panel member preliminary to the mating thereof with said front panel member.

7. The wall assembly, as claimed in claim 1, wherein: said locking slots of said male member extend along a path including inwardly from said free edge of said male member.

8. The wall assembly, as claimed in claim 3, wherein: said top cap member includes a top plate which extends longitudinally of the top edges of said first and second wallboard sheets, a pair of vertical side plates which extend downwardly from said top plate adjacent the respective outer faces of said first and second wallboard sheets, and a pair of intermediate vertical plates spaced inwardly from said side plates to define said slots into which said first and second wallboard sheets are received.

9. The wall assembly, as claimed in claim 8, wherein: said intermediate vertical plates of said top cap member are formed by making U-shaped cuts in said top plate and thereafter folding the resultant tabs produced by said U-shaped cuts downwardly about axes parallel to the vertical planes of said wallboard sheets.

10. A panel member for use in preparing a wall assembly, comprising:

a sheet of wallboard having an outer face and an inner face and having vertical side edges;

at least a pair of spaced L-shaped elements attached to said inner face of said wallboard sheet, each of said L-shaped elements including a foot portion and a stem, and said stem having a free edge;

each of said L-shaped elements being positioned vertically with said foot portion thereof flush against said wallboard sheet with said two of said L-shaped elements being positioned slightly recessed with respect to said edges of said wallboard sheet and with said foot portions thereof directed inwardly, said free edge of said stem of each of said L-shaped elements formed into a S-shaped fold to provide a vertical slot that extends substantially the length of the corresponding L-shaped element and thereby defines a female member adapted to enter into a female-male mating relationship with a cooperating opposing member on another engageable panel member; and a plurality of vertically spaced, substantially horizontal pin members wherein each of said pin members intersects the free edge of one of said L-shaped elements at least twice and thereby transverses the slot which defines the corresponding female member; and said outer face of said wallboard sheet being provided with a thin layer of wall covering which extends over said outer face of said wallboard sheet, said layer of wall covering being of a different composition than the basic composition of said wallboard sheet.

11. A method for constructing a vertical partition wall assembly in an enclosure having a ceiling and a floor, comprising:

attaching to the ceiling of the enclosure a top cap member having longitudinally extending plates defining laterally-spaced rearward and forward longitudinal slots for receiving top edges of two wallboard sheets, said top cap member being positioned above the floor of the enclosure at a height substantially that of the to-be-constructed partition;

inserting into the rearward slot of said longitudinal slots of said top cap member the top edge of a back panel member, said back panel member comprising:

(a) a first sheet of wallboard having an outer face and an inner face, (b) at least a pair of spaced, first L-shaped elements attached to said inner face of said first wallboard sheet, each of said first L-shaped elements having a foot portion and a stem, each of said first L-shaped elements being positioned vertically with said foot portion thereof flush against said first wallboard sheet and said stem thereof extending laterally from the first wallboard sheet, a free edge of said stem of each of said first L-shaped elements having a vertical slot provided therein extending substantially the length thereof and defining a female member, (c) a plurality of spaced, pin members positioned substantially horizontally within and intermediate the lateral depth of each of said female member slots and, (d) a generally U-shaped bottom plate member attached to said inner face of said first wallboard sheet at a bottom edge thereof; laterally adjusting said outer face of said back panel member to align said bottom edge of said back panel member along a predetermined path on the enclosure floor;

anchoring said bottom member to the enclosure floor to position said back panel member along said predetermined path on the enclosure floor;

bringing thereafter a front panel member comprising:

(a) a second sheet of wallboard having an outer face and an inner face, (b) at least a pair of spaced second L-shaped elements, each of said second L-shaped elements having a foot portion and a stem, each of the second L-shaped elements being positioned vertically with said foot portion thereof flush against said second wallboard sheet, a free edge of said stem of each of said second L-shaped elements defining a male member, and (c) a plurality of spaced, locking slots positioned on each of said male members, said locking slots extending inwardly from said free edges of said male members into releasable engagement with said back panel member so that said male members each are received within a cooperatively engaging female member and said pin members are received within said locking slots on said male members and so that the top edge of said front panel member is received within said forward slot of said longitudinal slots of said top cap member; and (d) joining said front panel member with said back panel member with said pin members releasably engaged in said locking slots.

12. The method, as claimed in claim 1, wherein:

said outer face of at least one of said front and back panel members is provided with a thin layer of wall covering different from the basic composition of the wallboard sheet to which said thin layer is attached, and said thin layer of wall covering being attached to said respective wallboard sheet before forming the wall partition.

13. The method, as claimed in claim 11, wherein:

before joining said front panel member to said back panel member, electrical service elements are attached to said inner face of said back panel member.

14. The method, as claimed in claim 11, wherein:

said top cap member includes at least two separate sections abutting end-to-end and said two top cap member sections being connected together at their abutment by a joining means which bridges the junction therebetween.

* * * * *